US008016908B2

(12) United States Patent
Slaughter

(10) Patent No.: US 8,016,908 B2
(45) Date of Patent: Sep. 13, 2011

(54) METAL POWDER PRODUCTION SYSTEM AND METHOD

(75) Inventor: Victor Blakemore Slaughter, Manchester, MO (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 12/892,361

(22) Filed: Sep. 28, 2010

(65) Prior Publication Data

US 2011/0011207 A1 Jan. 20, 2011

Related U.S. Application Data

(62) Division of application No. 11/953,276, filed on Dec. 10, 2007, now Pat. No. 7,829,011.

(51) Int. Cl.
*B22F 9/04* (2006.01)

(52) U.S. Cl. ..... 75/255; 75/336

(58) Field of Classification Search ..... 75/255, 75/331, 336

See application file for complete search history.

(56) References Cited

U.S. PATENT DOCUMENTS 4,295,808 A * 10/1981 Stephan et al. ..... 425/8
4,762,975 A * 8/1988 Mahoney et al. ..... 219/69.1

* cited by examiner

*Primary Examiner* — Scott Kastler
(74) *Attorney, Agent, or Firm* — Randy W. Tung

(57) ABSTRACT

A metal powder production system includes a vacuum chamber having a vacuum chamber interior, a stock feed mechanism communicating with the vacuum chamber interior, a radiation source provided in the vacuum chamber interior, a cooling chamber having a cooling chamber interior communicating with the vacuum chamber interior and a container communicating with the cooling chamber interior. A metal powder production method is also disclosed.

5 Claims, 5 Drawing Sheets

METAL POWDER PRODUCTION SYSTEM AND METHOD

This is a Divisional of a application Ser. No. 11/953,276 filed on Dec. 10, 2007 now U.S. Pat. No. 7,829,011.

TECHNICAL FIELD

The disclosure relates to production of metal powder. More particularly, the disclosure relates to a metal powder production system and method in which metal powder is formed by striking a metal target or stock with an electron beam.

BACKGROUND

Metal powders may be necessary in a variety of fabrication methods. Metal powders may be expensive and may have long lead times and a small supply base. Powder production processes may include plasma rotating electrode process (PREP), gas atomized (GA), water atomized, centrifugal atomization, plasma atomization, comminution, mechanical alloying, oxide reduction, chloride reduction, hydrometallurgical techniques and carbonyl reaction. PREP and GA may be of particular importance to production.

A common drawback of conventional metal powder-producing methods may include the requirement of input stock of a particular form, generally a costly form. The variety of processes may produce powders having a variety of qualities and size distribution. The whole supply base may suffer due to the small number of suppliers. Therefore, a low-cost alternative to producing metal powder is needed.

SUMMARY

The disclosure is generally directed to a metal powder production system. An illustrative embodiment of the metal powder production system includes a vacuum chamber having a vacuum chamber interior, a stock feed mechanism communicating with the vacuum chamber interior, a radiation source provided in the vacuum chamber interior, a cooling chamber having a cooling chamber interior communicating with the vacuum chamber interior and a container communicating with the cooling chamber interior.

The disclosure is further generally directed to a metal powder production method. An illustrative embodiment of the metal powder production system includes providing a metal stock, providing a chamber, inducing a vacuum in the chamber, feeding the metal stock into the chamber, forming powder-forming particles by directing an energy source against the stock and forming solid metal powder particles by cooling the powder-forming particles.

BRIEF DESCRIPTION OF THE ILLUSTRATIONS

DETAILED DESCRIPTION

The disclosure is generally directed to a metal powder production system and method in which metal powder may be formed by striking a metal target or stock with an electron beam. As the electron beam strikes the metal stock, powder-forming droplets may be formed and fall through a cooling tower. In the cooling tower, the powder-forming droplets may cool to form metal powder which may be collected in a powder-collecting container at the bottom of the cooling tower. The metal powder production system and method may provide a low-cost alternative to the production of metal powders which may be utilized in any of a variety of fabrication industries, including but not limited to the aerospace industry.

Figure 1:
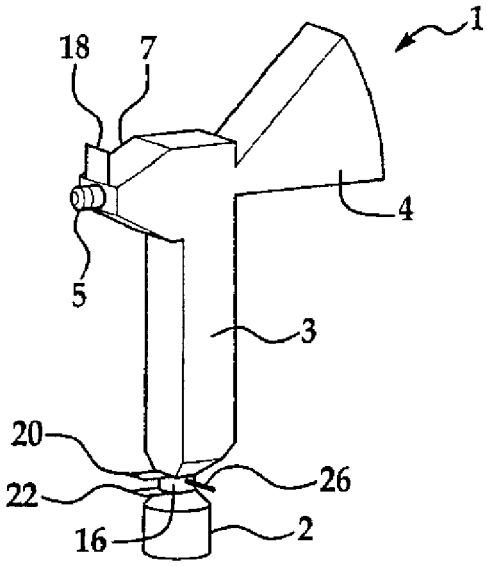
FIG. 1 is a perspective view of an illustrative embodiment of the metal powder production system.
Figure 2:
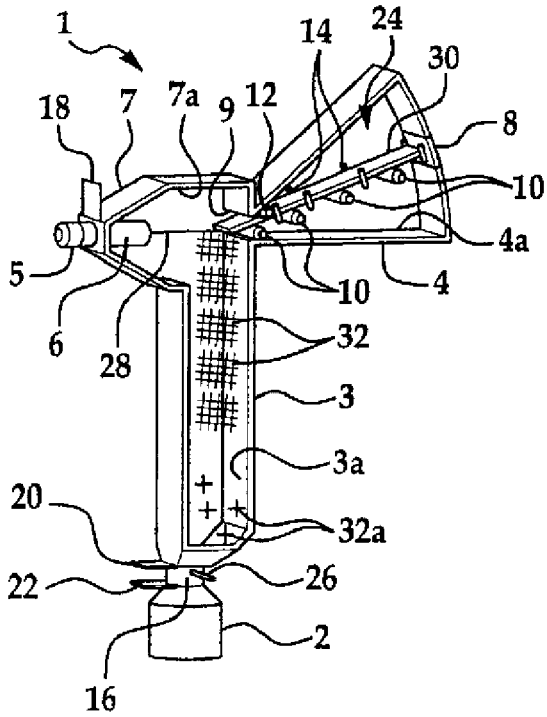
FIG. 2 is an interior view of an illustrative embodiment of the metal powder production system, more particularly illustrating production of metal powder by striking a metal target or stock with an electron beam.
Figure 3:
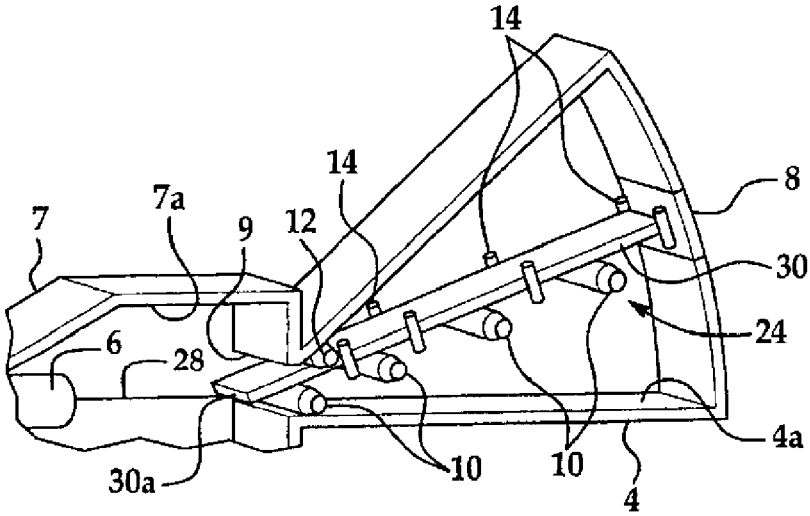
FIG. 3 is an interior view of a stock of an illustrative embodiment of the metal powder production system, illustrating a metal stock loaded in a stock housing and an electron beam striking the metal stock.
Figure 4:
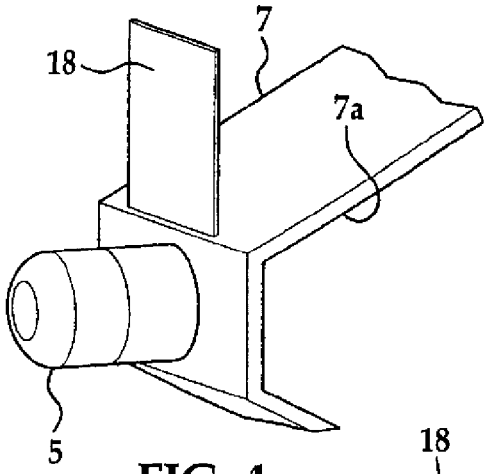
FIG. 4 is a perspective view of an electron beam gun of an illustrative embodiment of the metal powder production system.
Figure 5:
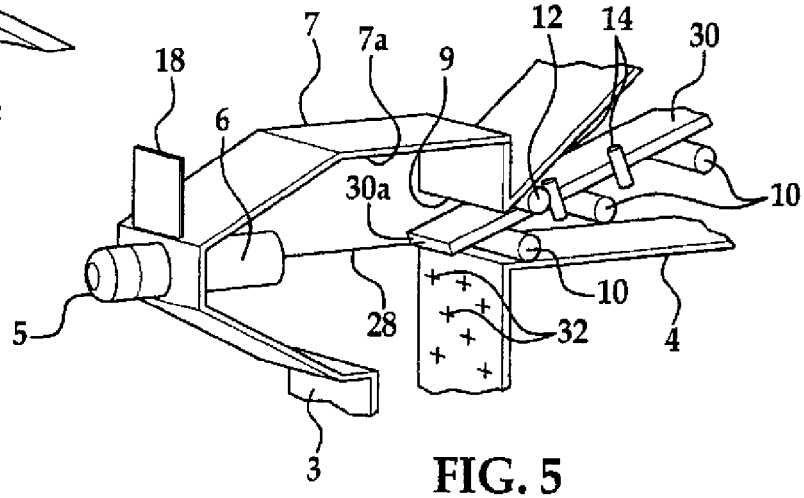
FIG. 5 is a perspective view, partially in section, of an interior of the metal powder production system, with the electron beam striking the metal stock.
Figure 6:
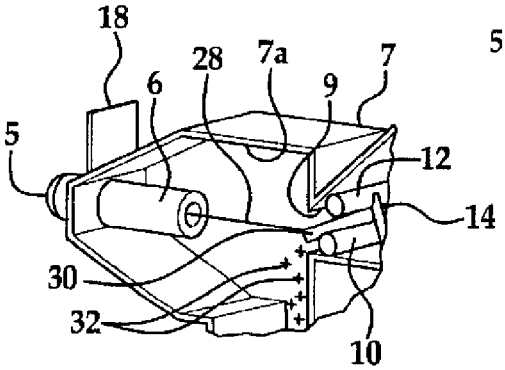
FIG. 6 is a perspective view of the electron beam gun inside the metal powder production system (shown partially in section), with an electron beam emitted from the electron beam gun and striking the metal stock.
Figure 7:
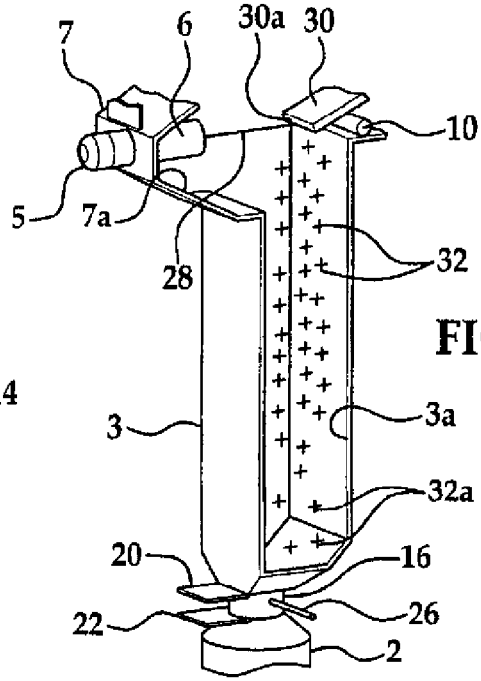
FIG. 7 is an interior view, partially in section, of the metal powder production system, with powder-forming droplets falling from the metal stock through a cooling tower as the metal stock is struck by the electron beam.

Referring initially to FIGS. 1-11, an illustrative embodiment of the metal powder production system, hereinafter system, is generally indicated by reference numeral 1 in FIGS. 1 and 2. The system 1 may include a generally elongated cooling chamber 3 having a cooling chamber interior 3*a*, as shown in FIG. 2. A vacuum chamber 7, having a vacuum chamber interior 7*a*, as shown in FIG. 2, may be provided on an upper end of the cooling chamber 3. The cooling chamber interior 3*a* of the cooling chamber 3 may communicate with the vacuum chamber interior 7*a* of the vacuum chamber 7. A stock housing 4 may extend from the upper end portion of the cooling chamber 3. The stock housing 4 may have a stock housing interior 4*a* which communicates with the vacuum chamber interior 7*a* of the tower head 7, as further shown in FIG. 2. A stock opening may establish communication between the stock housing interior 4*a* of the stock housing 4 and the vacuum chamber interior 7*a* of the vacuum chamber 7. As shown in FIGS. 2 and 3, a removable stock loading door 8 may be provided in the stock housing 4 for purposes which will be hereinafter described.

As shown in FIGS. 1, 2 and 4-7, a radiation source, such as an electron beam gun 5, for example and without limitation, may be provided on the vacuum chamber 7. The electron beam gun 5 may include Arcam® coils (not shown) supplied by the Arcam® corporation. As shown in FIGS. 2, 3 and 5-7, a drift tube 6 may communicate with the discharge end of the electron beam gun 5 and extend into the vacuum chamber interior 7*a* of the vacuum chamber 7. As shown in FIGS. 2, 3, 5 and 6, the drift tube 6 may be generally aimed toward the stock opening 9 which establishes communication between the stock housing interior 4*a* of the stock housing 4 and the vacuum chamber interior 7*a* of the vacuum chamber 7. The electron beam gun 5 may be adapted to emit an electron beam 28 through the drift tube 6, toward the stock opening 9 and against a metal stock 30 provided in the stock housing interior 4*a* of the stock housing 4. A gun shutter 18 may be provided on the vacuum chamber 7, generally adjacent to the electron beam gun 5 to isolate the electron beam gun 5 for filament changes.

Figure 11:
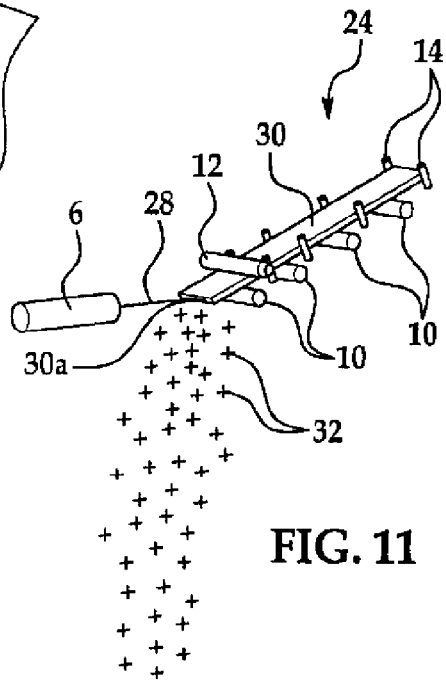
FIG. 11 is a perspective view illustrating multiple powder-forming droplets falling from the metal stock as the electron beam strikes the metal stock.

As shown in FIGS. 2, 3 and 11, a stock feed mechanism 24 may be provided in the stock housing interior 4*a* of the stock housing 4. The stock feed mechanism 24 may include multiple idle stock rollers 10 may be provided in the stock housing interior 4*a* of the stock housing 4. The idle stock rollers 10 may be adapted to receive and support the metal stock 30 in the stock housing interior 4*a* of the stock housing 4. The idle stock rollers 10 may define a plane which is generally sloped with respect to a horizontal plane. The slope angle or pitch of the plane of the idle stock rollers 10 may vary depending on the characteristics of the metal stock 30, interaction of the electron beam 28 with the metal stock 30 and droplet formation (e.g. wetting characteristics and surface tension), for example and without limitation. At least one powered stock roller 12 may be provided in the stock housing interior 4*a* generally adjacent to the plane which is defined by the idle stock rollers 10. The at least one powered stock roller 12 may engage the metal stock 30 as the metal stock 30 rests on the idle stock rollers 10. A drive motor (not shown) may drivingly engage the at least one powered stock roller 12 to facilitate powered rotation of the at least one powered stock roller 12. Accordingly, operation of at least one powered stock roller 12 may advance the metal stock 30 toward the stock opening 9. At least one powered stock roller 12 may also be used to index the metal stock 30 during production. Multiple pairs of spaced-apart stock stabilizers 14 may be provided in the stock housing interior 4*a*, on respective sides of the plane which is defined by the idle stock rollers 10 to stabilize the metal stock 30 on the idle stock rollers 10.

A powder-collecting container 2 may be detachably coupled to a lower end of the cooling chamber 3 such as through a suitable can connector 16, for example and without limitation. The container connector 16 may couple the powder-collecting container 2 to the cooling chamber 3 in an airtight manner. An inert gas line 26 may extend from the container connector 16 and communicate with the interior of the powder-collecting container 2. The inert gas line 26 may be adapted for connection to an inert gas source (not shown) for purposes which will be hereinafter described.

Figure 8:
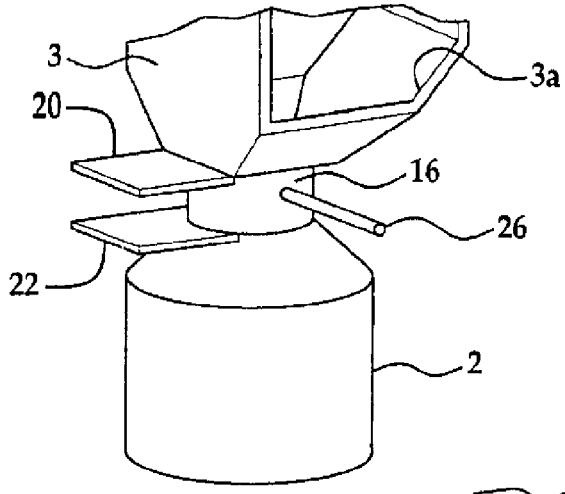
FIG. 8 is a perspective view of a powder-collecting container attached to a cooling tower (partially in section) of the metal powder production system.

As shown in FIGS. 1, 2 and 8, a chamber shutter may be provided at the junction between the cooling chamber 3 and the container connector 16. A container shutter 22 may be provided at the junction between the container connector 16 and the powder-collecting container 2. The chamber shutter 20 is adapted to selectively seal the container connector 16 from the cooling chamber interior 3*a* (FIG. 2) of the cooling chamber 3. The container shutter 22 is adapted to selectively seal the interior of the powder-collecting container 2 from the container connector 16, for purposes which will be hereinafter described.

In typical application of the system 1, a metal stock 30 may be placed on the idle stock rollers 10 in the stock housing interior 4*a* of the stock housing 4, as shown in FIGS. 2 and 3. The metal stock 30 may be loaded on the idle stock rollers 10 and in engagement with the powered stock roller or rollers 12 in the stock housing interior 4*a* through the stock loading door 8 provided in the stock housing 4. A vacuum may then be induced in the vacuum chamber interior 7*a* of the vacuum chamber 7 according to the knowledge of those skilled in the art. The powered stock roller or rollers 12 may then be operated to properly position the face 30*a* of the metal stock 30 with respect to the path of the electron beam 28 which is to be emitted by the electron beam gun 5 as the metal stock 30 rolls on the idle stock rollers 10.

Figure 9:
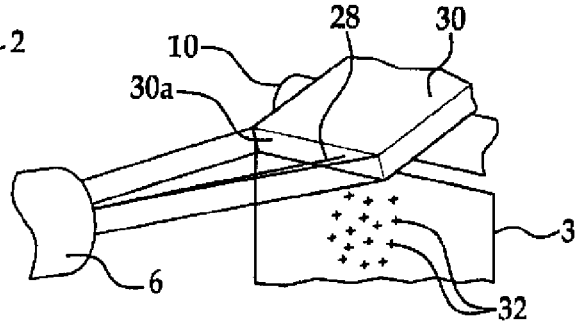
FIG. 9 is a perspective view illustrating the effects of astigmatism coils on generating consistent spot size and form of the electron beam as it impinges on the metal stock.
Figure 10:
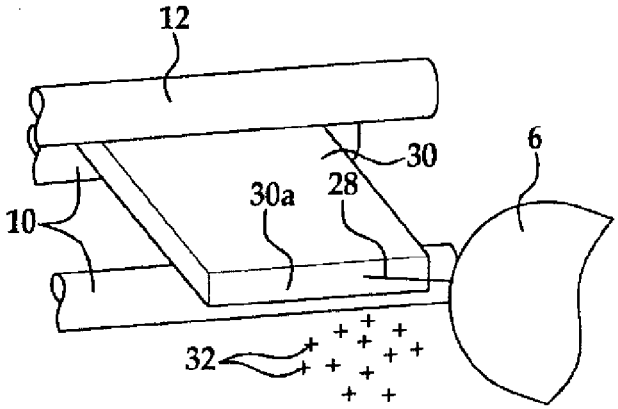
FIG. 10 is a perspective view which illustrates striking of the metal stock by the electron beam.

After the face 30*a* of the metal stock 30 has been properly positioned with respect to the path of the electron beam 28, the electron beam gun 5 may be operated to emit the electron beam 28 through the drift tube 6 and against the face 30*a* of the metal stock 30. Accordingly, the electron beam 28 may dislodge metal atoms from the metal stock 30 in the form of powder-forming droplets 32, as shown in FIGS. 2, 5-7 and 9-11. As shown in FIG. 9, astigmatism coils may allow for consistent spot size and form even if the metal stock 30 is oriented at an angle with respect to the path of the electron beam 28. The flexibility of the Arcam® coils in the electron beam gun 5 may be leveraged to produce separated powder-forming droplets 30 without reliance on movement of the metal stock or high-velocity gases to separate individual powder-forming droplets 30. A high degree of speed and flexibility may enable many different strategies for optimal production without need for hardware changes.

Upon being dislodged from the metal stock 30, the powder-forming droplets 32 may fall through the cooling chamber interior 3*a* of the cooling chamber 3. In the cooling chamber 3, the powder-forming droplets 32 may cool and solidify to form metal powder 32*a* (FIGS. 2 and 7) which may be collected in the powder-collecting container 2. The nature of the formation of the powder-forming droplets 32 may lead to very consistent-narrow distribution-metal powder 32*a*. The chamber shutter 20 and the container shutter 22 may remain open to facilitate collection of the metal powder 32*a* in the powder-collecting container 2.

Upon filling of the powder-collecting container 2 with the metal powder 32*a*, the chamber shutter 20 may be closed while the container shutter 22 may remain open. An inert gas source (not shown) may be connected to the inert gas line 26. An inert gas (not shown) may be introduced into the powder-collecting container 2 through the inert gas line 26. The container shutter 22 may then be closed and the powder-collecting container 2 uncoupled from the container connector 16 and sealed. An empty or replacement powder-collecting container 2 may then be coupled to the container connector 16 and the chamber shutter 20 and container shutter 22 opened to resume production of the metal powder 32*a*.

During production of the metal powder 32*a*, the Arcam® coils (not shown) which may be provided in the electron beam gun 5 may provide for deflection over a wide range of sizes of the metal stock 30. The Arcam® coils may be able to deflect the impact spot of the electron beam 28 with the face 30*a* of the metal stock 30 at a speed of 25,000 mm/s or faster. The electron beam gun 5 may be capable of supporting multiple melt pools. Separation of the powder-forming droplets 32 in the cooling chamber 3 may be a function of the electron beam spot travel and dwell parameters. Pitch of the metal stock 30 with respect to the path of the electron beam 28 may be determined by material characteristics of the metal stock 30, electron beam 28/metal stock 30 interaction and formation of the powder-forming droplets 32 (e.g. wetting characteristics and surface tension). In some cases, a vibration may be induced in the metal stock 30 to help overcome surface tension. A small quantity of inert gas may be needed to avoid charging of the particles of metal powder 30*a* in the powder-collecting container 2.

Figure 12:
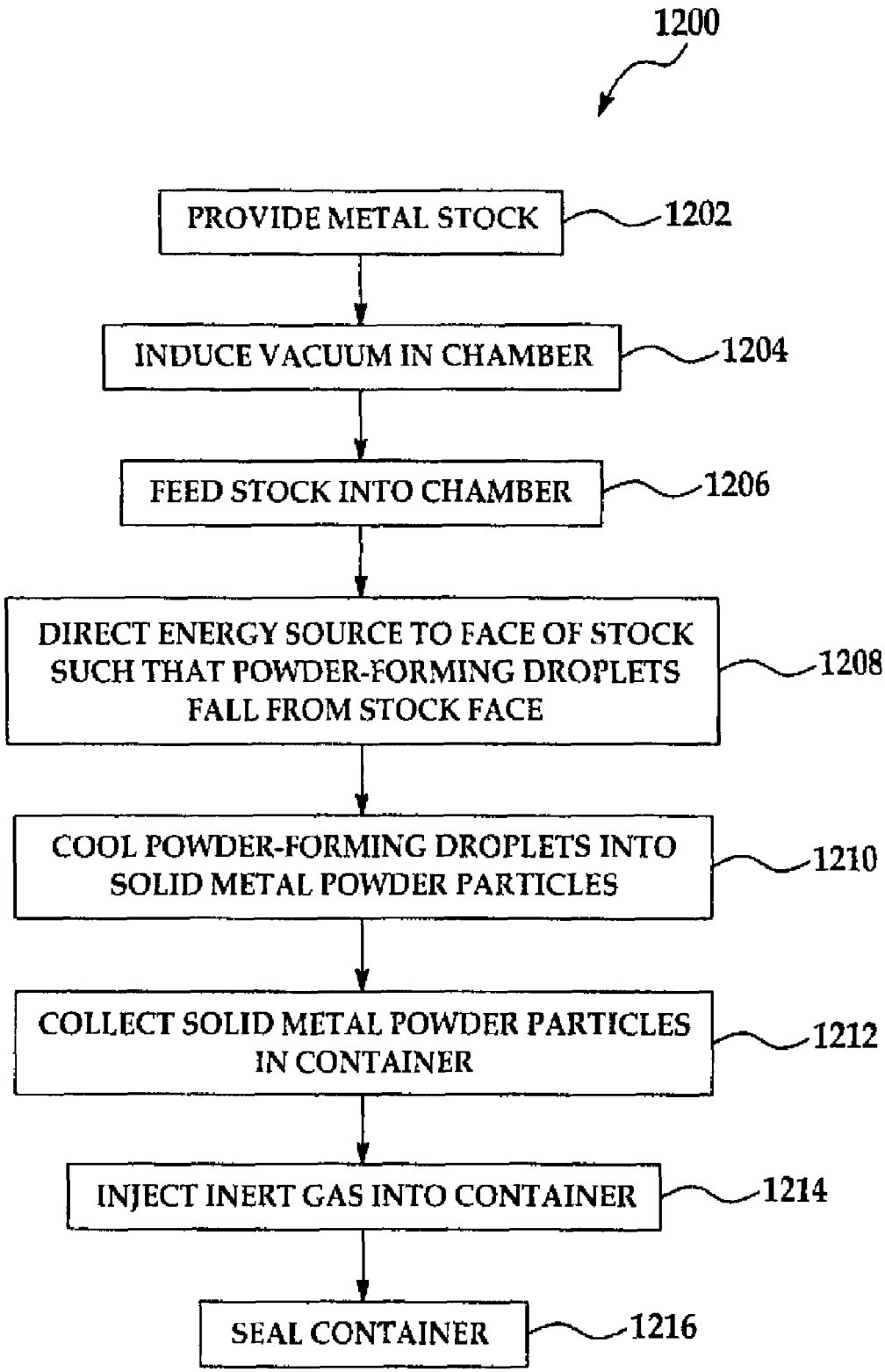
FIG. 12 is a flow diagram of an illustrative embodiment of a metal powder production method.

Referring next to FIG. 12, a flow diagram 1200 of an illustrative embodiment of a metal powder production method is shown. In block 1202, a metal stock may be provided. In block 1204, a vacuum may be induced in a chamber. In block 1206, the stock may be fed into the chamber. In block 1208, an energy source may be directed to a face of the stock such that powder-forming droplets may fall from the face of the stock. In block 1210, the powder-forming droplets may cool to form solid metal powder particles. In block 1212, the solid metal powder particles may be collected in a container. In block 1214, an inert gas may be injected into the container. In block 1212, the container may be sealed.

Figure 13:
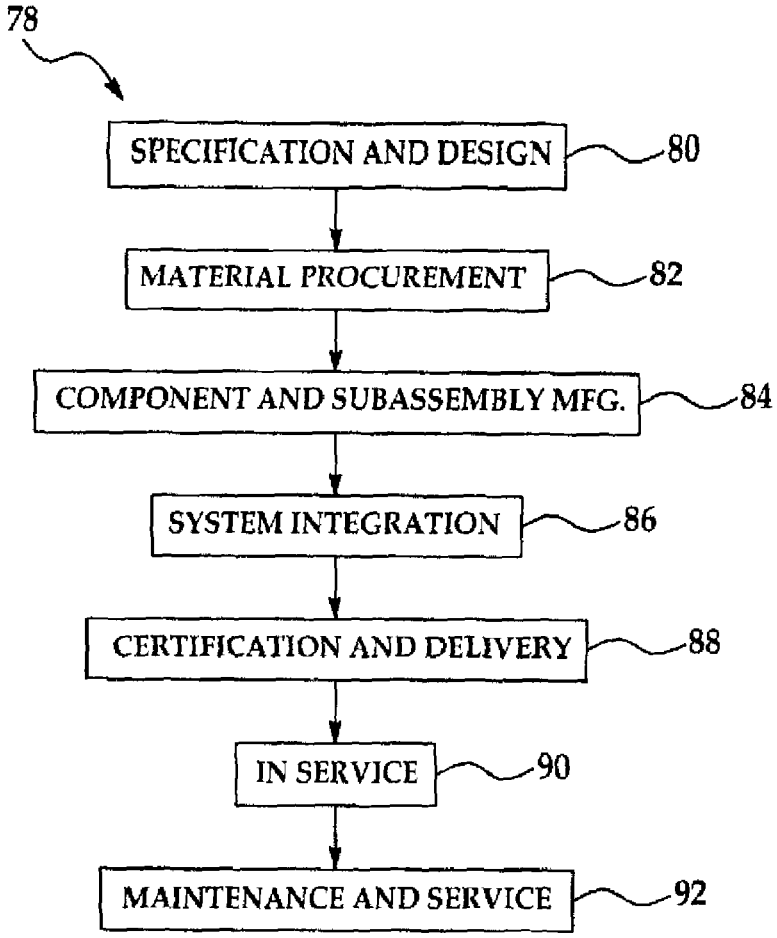
FIG. 13 is a flow diagram of an aircraft production and service methodology.
Figure 14:
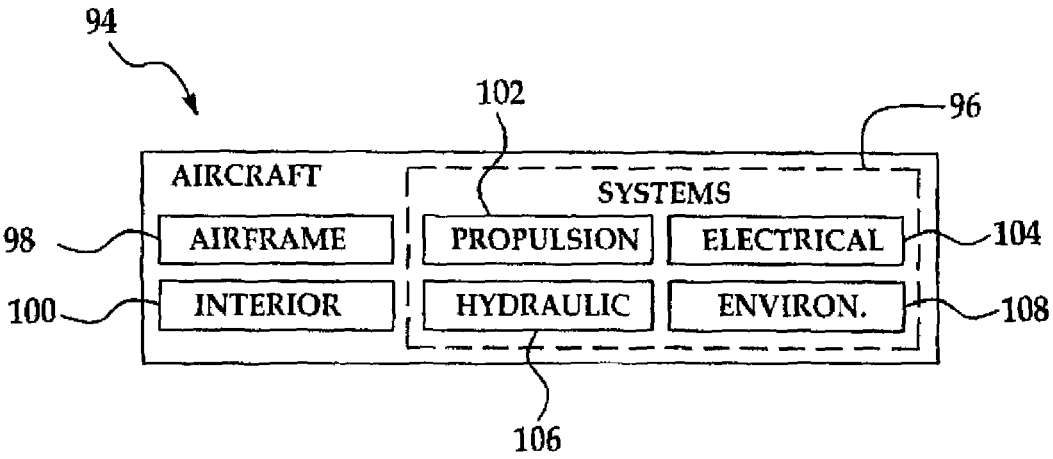
FIG. 14 is a block diagram of an aircraft.

Referring next to FIGS. 13 and 14, embodiments of the disclosure may be used in the context of an aircraft manufacturing and service method 78 as shown in FIG. 13 and an aircraft 94 as shown in FIG. 14. During pre-production, exemplary method 78 may include specification and design 80 of the aircraft 94 and material procurement 82. During production, component and subassembly manufacturing 84 and system integration 86 of the aircraft 94 takes place. Thereafter, the aircraft 94 may go through certification and delivery 88 in order to be placed in service 90. While in service by a customer, the aircraft 94 may be scheduled for routine maintenance and service 92 (which may also include modification, reconfiguration, refurbishment, and so on).

Each of the processes of method 78 may be performed or carried out by a system integrator, a third party, and/or an operator (e.g., a customer). For the purposes of this description, a system integrator may include without limitation any number of aircraft manufacturers and major-system subcontractors; a third party may include without limitation any number of vendors, subcontractors, and suppliers; and an operator may be an airline, leasing company, military entity, service organization, and so on.

As shown in FIG. 14, the aircraft 94 produced by exemplary method 78 may include an airframe 98 with a plurality of systems 96 and an interior 100. Examples of high-level systems 96 include one or more of a propulsion system 102, an electrical system 104, a hydraulic system 106, and an environmental system 108. Any number of other systems may be included. Although an aerospace example is shown, the principles of the invention may be applied to other industries, such as the automotive industry.

The apparatus embodied herein may be employed during any one or more of the stages of the production and service method 78. For example, components or subassemblies corresponding to production process 84 may be fabricated or manufactured in a manner similar to components or subassemblies produced while the aircraft 94 is in service. Also, one or more apparatus embodiments may be utilized during the production stages 84 and 86, for example, by substantially expediting assembly of or reducing the cost of an aircraft 94. Similarly, one or more apparatus embodiments may be utilized while the aircraft 94 is in service, for example and without limitation, to maintenance and service 92.

Although the embodiments of this disclosure have been described with respect to certain exemplary embodiments, it is to be understood that the specific embodiments are for purposes of illustration and not limitation, as other variations will occur to those of skill in the art.

What is claimed is:

1. A metal powder production method, comprising:
providing a metal stock;
providing a chamber;
inducing a vacuum in said chamber;
feeding said metal stock into said chamber;
forming powder-forming particles by directing not more than one energy source against said stock; and
collecting solid metal powder particles emitted directly from said stock by cooling said powder-forming, particles.

2. The method of claim 1 further comprising providing a container and collecting said solid metal powder particles in said container.

3. The method of claim 2 further comprising injecting an inert gas into said container and sealing said container.

4. The method of claim 2 wherein said directing an energy source against said stock comprises directing an electron beam against said stock.

5. The method of claim 1 wherein said feeding said metal stock into said chamber comprises providing a stock feed mechanism comprising a plurality of idle stock rollers and at least one powered stock roller, supporting said metal stock on said plurality of idle stock rollers, causing engagement of said at least one powered stock roller with said metal stock and advancing said metal stock by operation of said at least one powered stock roller.

* * * * *